US008880394B2

(12) United States Patent
Parikh et al.

(10) Patent No.: US 8,880,394 B2
(45) Date of Patent: Nov. 4, 2014

(54) METHOD, SYSTEM AND COMPUTER PROGRAM PRODUCT FOR SUPPRESSING NOISE USING MULTIPLE SIGNALS

(75) Inventors: Devangi Nikunj Parikh, Atlanta, GA (US); Muhammad Zubair Ikram, Richardson, TX (US); Takahiro Unno, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 333 days.

(21) Appl. No.: 13/589,250

(22) Filed: Aug. 20, 2012

(65) Prior Publication Data

US 2013/0046535 A1 Feb. 21, 2013

Related U.S. Application Data

(60) Provisional application No. 61/524,928, filed on Aug. 18, 2011.

(51) Int. Cl.

*G10L 21/02* (2013.01)
*G10L 21/0216* (2013.01)
*G10L 21/0208* (2013.01)

(52) U.S. Cl.

CPC ..... *G10L 21/0216* (2013.01); *G10L 21/0208* (2013.01); *G10L 2021/02161* (2013.01)
USPC ..... 704/226; 704/233; 704/225; 704/227; 379/406.06; 381/94.2; 381/94.1; 381/66

(58) Field of Classification Search

CPC ..... G01L 21/0208; G01L 21/0232; G01L 21/0205; G01L 19/083; G01L 19/005; G01L 19/012; G01L 15/20; G01L 25/78; G01L 25/69; G01L 25/87
USPC ..... 704/226–228, 233, 225, 500–504
See application file for complete search history.

(56) References Cited

U.S. PATENT DOCUMENTS 7,626,889 B2 * 12/2009 Seltzer et al. ..... 367/125
8,654,990 B2 * 2/2014 Faller ..... 381/92
8,660,281 B2 * 2/2014 Bouchard et al. ..... 381/312

(Continued)

OTHER PUBLICATIONS

Ephraim et al., "Speech Enhancement Using a Minimum Mean-Square Error Short-Time Spectral Amplitude Estimator", IEEE Transaction on Acoustics, Speech, and Signal Processing, Dec. 1984, pp. 1109-1121, vol. ASSP-32, No. 6, IEEE.

(Continued)

*Primary Examiner* — Vijay B Chawan
(74) *Attorney, Agent, or Firm* — Michael A. Davis, Jr.; Frederick J. Telecky, Jr.

(57) ABSTRACT

In response to a first envelope within a kth frequency band of a first channel, a speech level within the kth frequency band of the first channel is estimated. In response to a second envelope within the kth frequency band of a second channel, a noise level within the kth frequency band of the second channel is estimated. A noise suppression gain for a time frame n is computed in response to the estimated speech level for a preceding time frame, the estimated noise level for the preceding time frame, the estimated speech level for the time frame n, and the estimated noise level for the time frame n. An output channel is generated in response to multiplying the noise suppression gain for the time frame n and the first channel.

30 Claims, 7 Drawing Sheets

(56) References Cited

U.S. PATENT DOCUMENTS

| | | | | |
|---|---|---|---|---|
| 2010/0131269 | A1* | 5/2010 | Park et al. | 704/233 |
| 2011/0123019 | A1 | 5/2011 | Gowreesunker et al. | |
| 2011/0286609 | A1* | 11/2011 | Faller | 381/92 |
| 2011/0305345 | A1* | 12/2011 | Bouchard et al. | 381/23.1 |

OTHER PUBLICATIONS

Parikh et al., "Perceptual Artifacts in Speech Noise Suppression", IEEE, 2010, pp. 99-103, Asilomar, Georgia Institute of Technology, Atlanta, GA, U.S.A.

Parikh et al., "Gain Adaptation Based on Signal-To-Noise Ratio for Noise Suppression", IEEE Workshop on Applications of Signal Processing to Audio and Acoustics, Oct. 18-21, 2009, pp. 185-188, IEEE, New Paltz, NY.

Takahashi et al., "Blind Spatial Subtraction Array for Speech Enhancement in Noisy Environment", IEEE Transactions on Audio, Speech, and Language Processing, May 2009, pp. 650-664, vol. 17 No. 4, IEEE.

Parikh et al., "Blind Source Separation with Perceptual Post Processing", IEEE DSP/SPE, 2011, pp. 321-325, Georgia Institute of Technology, Atlanta, GA, U.S.A.

Anderson, David V., "A Modulation View of Audio Processing for Reducing Audible Artifacts", IEEE ICASSP, 2010, pp. 5474-5477, Georgia Institute of Technology, Atlanta, GA, U.S.A.

Cappe, Oliver, "Elimination of the Musical Noise Phenomenon with the Ephraim and Mulah Noise Suppressor", Cappe: Elimination of the Musical Noise Phenomenon, Apr. 21, 1994 rev. Oct. 14, 1993, pp. 345-349, IEEE, Paris, France.

* cited by examiner

METHOD, SYSTEM AND COMPUTER PROGRAM PRODUCT FOR SUPPRESSING NOISE USING MULTIPLE SIGNALS

CROSS-REFERENCE TO RELATED APPLICATION

This application claims priority to U.S. Provisional Patent Application Ser. No. 61/524,928, filed Aug. 18, 2011, entitled METHOD FOR MULTIPLE MICROPHONE NOISE SUPPRESSION BASED ON PERCEPTUAL POST-PROCESSING, naming Devangi Nikunj Parikh et al. as inventors, which is hereby fully incorporated herein by reference for all purposes.

BACKGROUND

The disclosures herein relate in general to audio processing, and in particular to a method, system and computer program product for suppressing noise using multiple signals.

In mobile telephone conversations, improving quality of uplink speech is an important and challenging objective. If noise suppression parameters (e.g., gain) are updated too infrequently, then such noise suppression is less effective in response to relatively fast changes in the received signals. Conversely, if such parameters are updated too frequently, then such updating may cause annoying musical noise artifacts.

SUMMARY

In response to a first envelope within a kth frequency band of a first channel, a speech level within the kth frequency band of the first channel is estimated. In response to a second envelope within the kth frequency band of a second channel, a noise level within the kth frequency band of the second channel is estimated. A noise suppression gain for a time frame n is computed in response to the estimated speech level for a preceding time frame, the estimated noise level for the preceding time frame, the estimated speech level for the time frame n, and the estimated noise level for the time frame n. An output channel is generated in response to multiplying the noise suppression gain for the time frame n and the first channel.

DETAILED DESCRIPTION

Figure 1:
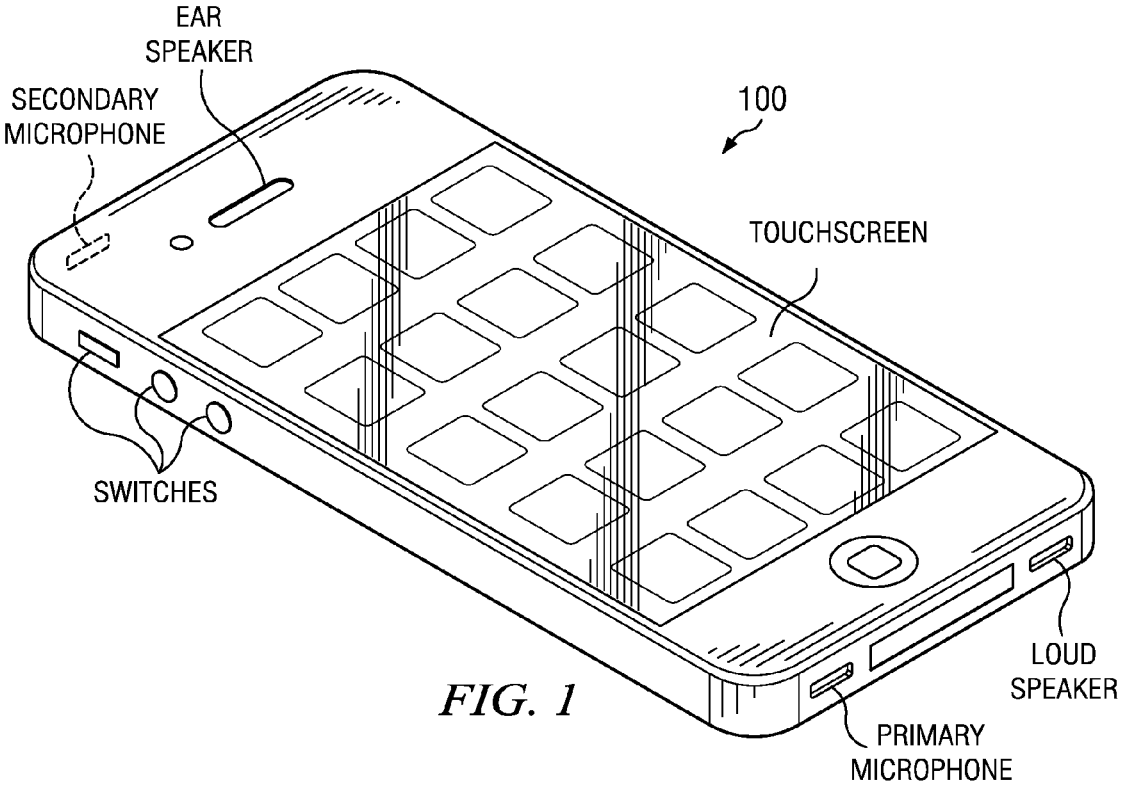
FIG. 1 is a perspective view of a mobile smartphone that includes an information handling system of the illustrative embodiments.

FIG. 1 is a perspective view of a mobile smartphone, indicated generally at 100, that includes an information handling system of the illustrative embodiments. In this example, the smartphone 100 includes a primary microphone, a secondary microphone, an ear speaker, and a loud speaker, as shown in FIG. 1. Also, the smartphone 100 includes a touchscreen and various switches for manually controlling an operation of the smartphone 100.

Figure 2:
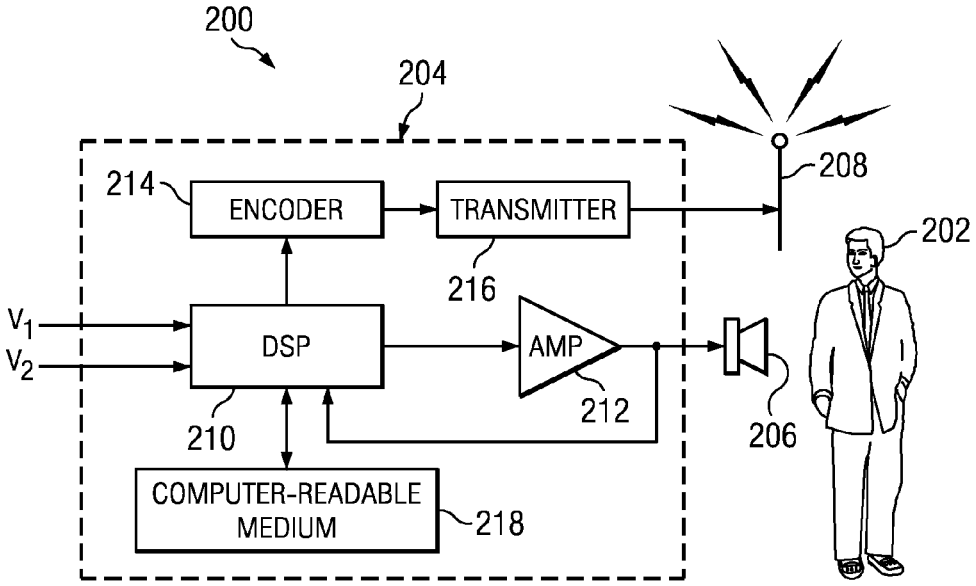
FIG. 2 is a block diagram of the information handling system of the illustrative embodiments.

FIG. 2 is a block diagram of the information handling system, indicated generally at 200, of the illustrative embodiments. A human user 202 speaks into the primary microphone (FIG. 1), which converts sound waves of the speech (from a voice of the user 202) into a primary voltage signal $V_1$. The secondary microphone (FIG. 1) converts sound waves of noise (e.g., from an ambient environment that surrounds the smartphone 100) into a secondary voltage signal $V_2$. Also, the signal $V_1$ contains the noise, and the signal $V_2$ contains leakage of the speech.

A control device 204 receives the signal $V_1$ (which represents the speech and the noise) from the primary microphone and the signal $V_2$ (which represents the noise and leakage of the speech) from the secondary microphone. In response to the signals $V_1$ and $V_2$, the control device 204 outputs: (a) a first electrical signal to a speaker 206; and (b) a second electrical signal to an antenna 208. The first electrical signal and the second electrical signal communicate speech from the signals $V_1$ and $V_2$, while suppressing at least some noise from the signals $V_1$ and $V_2$.

In response to the first electrical signal, the speaker 206 outputs sound waves, at least some of which are audible to the human user 202. In response to the second electrical signal, the antenna 208 outputs a wireless telecommunication signal (e.g., through a cellular telephone network to other smartphones). In the illustrative embodiments, the control device 204, the speaker 206 and the antenna 208 are components of the smartphone 100, whose various components are housed integrally with one another. Accordingly in a first example, the speaker 206 is the ear speaker of the smartphone 100. In a second example, the speaker 206 is the loud speaker of the smartphone 100.

The control device 204 includes various electronic circuitry components for performing the control device 204 operations, such as: (a) a digital signal processor ("DSP") 210, which is a computational resource for executing and otherwise processing instructions, and for performing additional operations (e.g., communicating information) in response thereto; (b) an amplifier ("AMP") 212 for outputting the first electrical signal to the speaker 206 in response to information from the DSP 210; (c) an encoder 214 for outputting an encoded bit stream in response to information from the DSP 210; (d) a transmitter 216 for outputting the second electrical signal to the antenna 208 in response to the encoded bit stream; (e) a computer-readable medium 218 (e.g., a non-volatile memory device) for storing information; and (f) various other electronic circuitry (not shown in FIG. 2) for performing other operations of the control device 204.

The DSP 210 receives instructions of computer-readable software programs that are stored on the computer-readable medium 218. In response to such instructions, the DSP 210 executes such programs and performs its operations, so that the first electrical signal and the second electrical signal communicate speech from the signals $V_1$ and $V_2$, while suppressing at least some noise from the signals $V_1$ and $V_2$. For executing such programs, the DSP 210 processes data, which are stored in memory of the DSP 210 and/or in the computer-readable medium 218. Optionally, the DSP 210 also receives the first electrical signal from the amplifier 212, so that the DSP 210 controls the first electrical signal in a feedback loop.

In an alternative embodiment, the primary microphone (FIG. 1), the secondary microphone (FIG. 1), the control device 204 and the speaker 206 are components of a hearing aid for insertion within an ear canal of the user 202. In one version of such alternative embodiment, the hearing aid omits the antenna 208, the encoder 214 and the transmitter 216.

Figure 3:
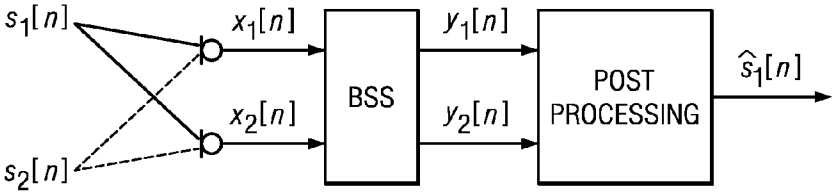
FIG. 3 is an information flow diagram of an operation of the system of FIG. 2.

FIG. 3 is an information flow diagram of an operation of the system 200. In accordance with FIG. 3, the DSP 210 performs an adaptive linear filter operation to separate the speech from the noise. In FIG. 3, $s_1[n]$ and $s_2[n]$ represent the speech (from the user 202) and the noise (e.g., from an ambient environment that surrounds the smartphone 100), respectively, during a time frame n. Further, $x_1[n]$ and $x_2[n]$ are digitized versions of the signals $V_1$ and $V_2$, respectively, of FIG. 2.

Accordingly: (a) $x_1[n]$ contains information that primarily represents the speech, but also the noise; and (b) $x_2[n]$ contains information that primarily represents the noise, but also leakage of the speech. The noise includes directional noise (e.g., a different person's background speech) and diffused noise. The DSP 210 performs a dual-microphone blind source separation ("BSS") operation, which generates $y_1[n]$ and $y_2[n]$ in response to $x_1[n]$ and $x_2[n]$, so that: (a) $y_1[n]$ is a primary channel of information that represents the speech and the diffused noise while suppressing most of the directional noise from $x_1[n]$; and (b) $y_2[n]$ is a secondary channel of information that represents the noise while suppressing most of the speech from $x_2[n]$.

After the BSS operation, the DSP 210 performs a post processing operation. In the post processing operation, the DSP 210: (a) in response to $y_2[n]$, estimates the diffused noise within $y_1[n]$; and (b) in response to such estimate, generates $\hat{s}_1[n]$, which is an output channel of information that represents the speech while suppressing most of the noise from $y_1[n]$. The DSP 210 performs the post processing operation within various frequency bands that are suitable for human perceptual auditory response. As discussed hereinabove in connection with FIG. 2, the DSP 210 outputs such $\hat{s}_1[n]$ information to: (a) the AMP 212, which outputs the first electrical signal to the speaker 206 in response to such $\hat{s}_1[n]$ information; and (b) the encoder 214, which outputs the encoded bit stream to the transmitter 216 in response to such $\hat{s}_1[n]$ information. Optionally, the DSP 210 writes such $\hat{s}_1[n]$ information for storage on the computer-readable medium 218.

Figure 4:
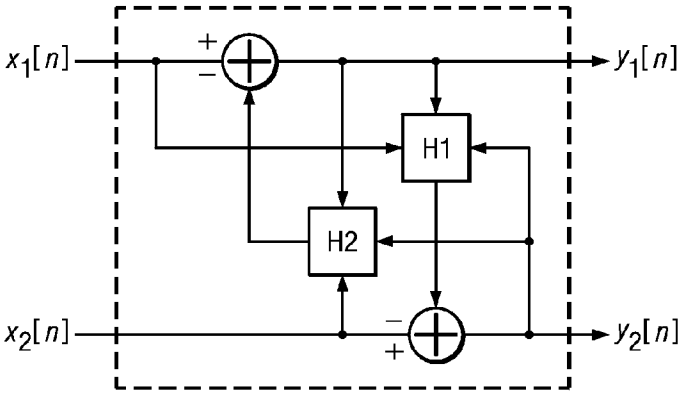
FIG. 4 is an information flow diagram of a blind source separation operation of FIG. 3.

FIG. 4 is an information flow diagram of the BSS operation of FIG. 3. A speech estimation filter H1: (a) receives $x_1[n]$, $y_1[n]$ and $y_2[n]$; and (b) in response thereto, adaptively outputs an estimate of speech that exists within $y_1[n]$. A noise estimation filter H2: (a) receives $x_2[n]$, $y_1[n]$ and $y_2[n]$; and (b) in response thereto, adaptively outputs an estimate of directional noise that exists within $y_2[n]$.

As shown in FIG. 4, $y_1[n]$ is a difference between: (a) $x_1[n]$; and (b) such estimated directional noise from the noise estimation filter H2. In that manner, the BSS operation iteratively removes such estimated directional noise from $x_1[n]$, so that $y_1[n]$ is a primary channel of information that represents the speech and the diffused noise while suppressing most of the directional noise from $x_1[n]$. Further, as shown in FIG. 4, $y_2[n]$ is a difference between: (a) $x_2[n]$; and (b) such estimated speech from the speech estimation filter H1. In that manner, the BSS operation iteratively removes such estimated speech from $x_2[n]$, so that $y_2[n]$ is a secondary channel of information that represents the noise while suppressing most of the speech from $x_2[n]$.

The filters H1 and H2 are adapted to reduce cross-correlation between $y_1[n]$ and $y_2[n]$, so that their filter lengths (e.g., 20 filter taps) are sufficient for estimating: (a) a path of the speech from the primary channel to the secondary channel; and (b) a path of the directional noise from the secondary channel to the primary channel. In the BSS operation, the DSP 210 estimates a level of a noise floor ("noise level") and a level of the speech ("speech level").

The DSP 210 computes the speech level by autoregressive ("AR") smoothing (e.g., with a time constant of 20 ms). The DSP 210 estimates the speech level as $P_s[n]=\alpha\cdot P_s[n-1]+(1-\alpha)\cdot y_1[n]^2$, where: (a) $\alpha=\exp(-1/F_s\tau)$; (b) $P_s[n]$ is a power of the speech during the time frame n; (c) $P_s[n-1]$ is a power of the speech during the immediately preceding time frame n−1; and (d) $F_s$ is a sampling rate. In one example, $\alpha=0.95$, and $\tau=0.02$.

The DSP 210 estimates the noise level (e.g., once per 10 ms) as: (a) if $P_s[n]>P_N[n-1]\cdot C_u$, then $P_N[n]=P_N[n-1]\cdot C_u$, where $P_N[n]$ is a power of the noise level during the time frame n, $P_N[n-1]$ is a power of the noise level during the immediately preceding time frame n−1, and $C_u$ is an upward time constant; or (b) if $P_s[n]<P_N[n-1]$. $C_d$, then $P_N[n]=P_N[n-1]\cdot C_d$, where $C_d$ is a downward time constant; or (c) if neither (a) nor (b) is true, then $P_N[n]=P_s[n]$. In one example, $C_u$ is 3 dB/sec, and $C_d$ is −24 dB/sec.

Figure 5:
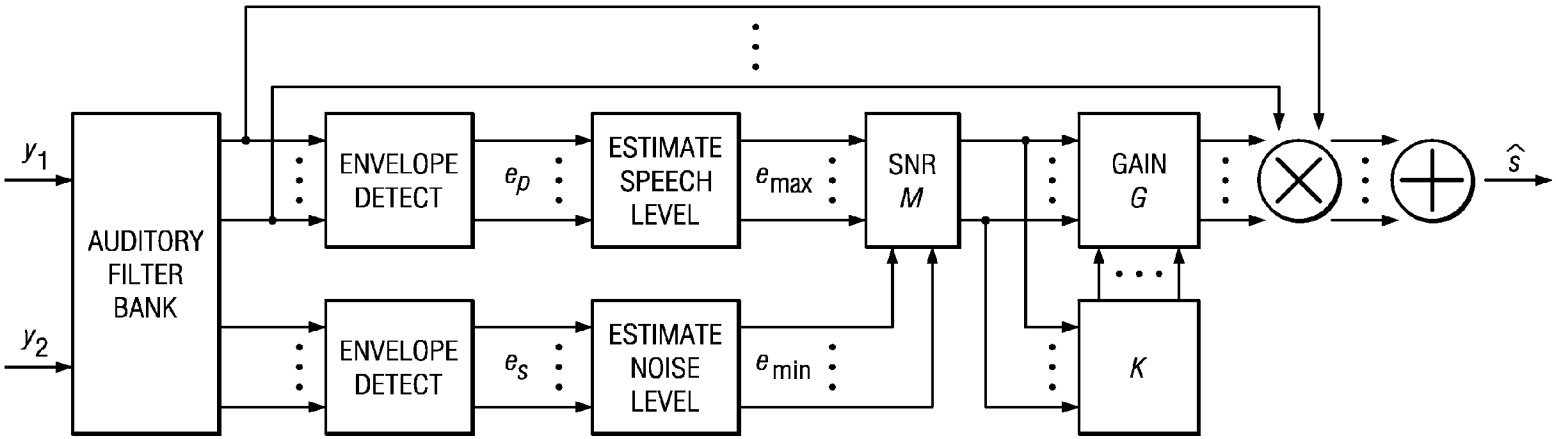
FIG. 5 is an information flow diagram of a post processing operation of FIG. 3.

FIG. 5 is an information flow diagram of the post processing operation. For simplicity of notation, FIG. 5 shows $y_1[n]$ and $y_2[n]$ as $y_1$ and $y_2$, respectively. Also, for simplicity of notation, FIG. 5 shows $\hat{s}_1[n]$ as $\hat{s}$.

Figure 6:
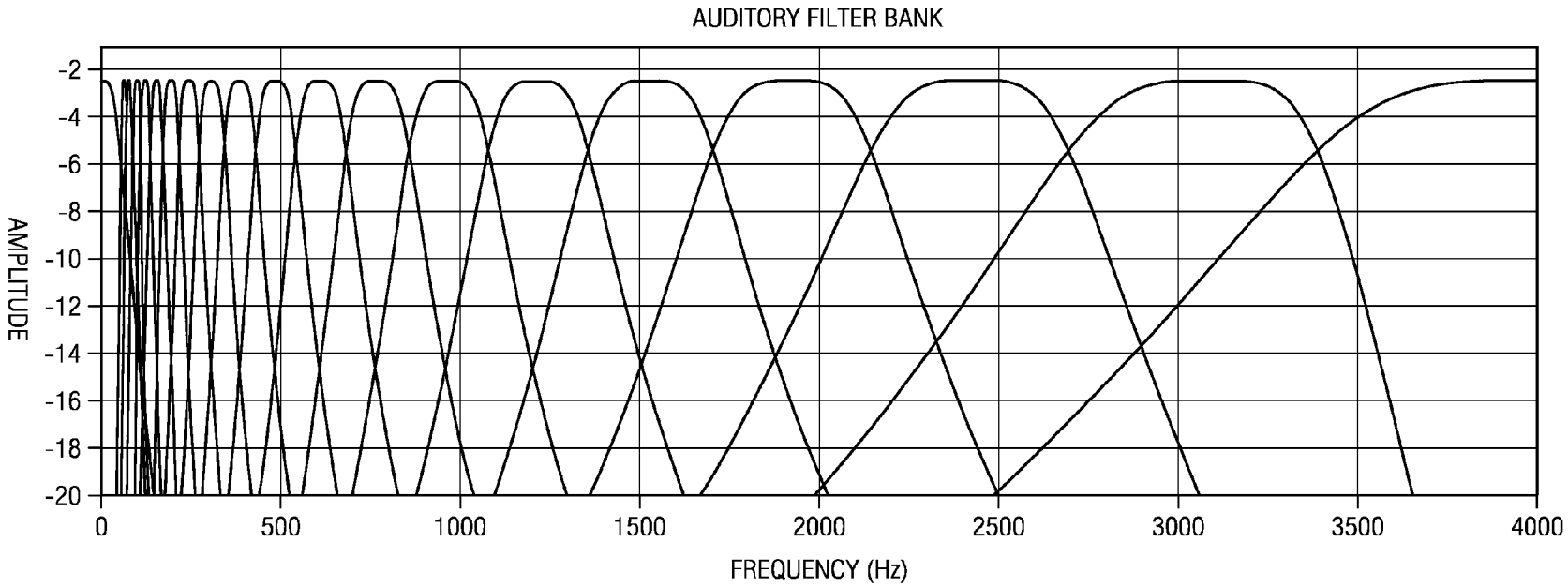
FIG. 6 is a graph of various frequency bands that are suitable for human perceptual auditory response, which are applied by an auditory filter bank operation of FIG. 5.

FIG. 6 is a graph of various frequency bands that are suitable for human perceptual auditory response. As shown in FIG. 6, each frequency band partially overlaps neighboring frequency bands. For example, in FIG. 6, one frequency band ranges from ~1350 Hz to 2500 Hz, and such frequency band partially overlaps: (a) a frequency band that ranges from ~850 Hz to ~1650 Hz; (b) a frequency band that ranges from ~1100 Hz to ~2000 Hz; (c) a frequency band that ranges from ~1650 Hz to ~3050 Hz; and (d) a frequency band that ranges from ~2000 Hz to ~3650 Hz.

A particular band is referenced as the kth band, where: (a) k is an integer number that ranges from 1 through N; and (b) N is a total number of such bands. Referring again to FIG. 5, in an auditory filter bank operation (which models a cochlear filter bank operation), the DSP 210: (a) receives $y_1$ and $y_2$ from the BSS operation; (b) converts $y_1$ from a time domain to a frequency domain, and decomposes the frequency domain version of $y_1$ into a primary channel of the N bands; and (c)

converts $y_2$ from time domain to frequency domain, and decomposes the frequency domain version of $y_2$ into a secondary channel of the N bands. By decomposing $y_1$ and $y_2$ into the primary and secondary channels of N bands that are suitable for human perceptual auditory response, instead of decomposing them with a fast Fourier transform ("FFT"), the DSP 210 is able to perform its noise suppression operation while preserving higher quality (e.g., less distortion, more naturally sounding, more intelligible, and more audible) speech with fewer artifacts.

From the kth band of the primary channel, the DSP 210 uses a low-pass filter to identify a respective envelope $e_{p_k}[n]$, so that such envelopes for all N bands are notated as $e_p$ in FIG. 5 for simplicity. Similarly, from the kth band of the secondary channel, the DSP 210 uses a low-pass filter to identify a respective envelope $e_{s_k}[n]$, so that such envelopes for all N bands are notated as $e_s$ in FIG. 5 for simplicity.

In response to $e_{p_k}[n]$, the DSP 210 estimates (e.g., once per millisecond) a respective speech level $e_{k_{max}}$ for the kth band as $$e_{k_{max}}=\max(\alpha_{speech}e_{k_{max}},e_{p_k}[n]), \tag{1}$$

where $\alpha_{speech}$ is a forgetting factor. The DSP 210 sets $\alpha_{speech}$ to implement a time constant, which is four (4) times higher than a time constant of the low-pass filter that the DSP 210 uses for identifying $e_{p_k}[n]$. In that manner, $e_{k_{max}}$ rises more quickly than it falls between the immediately preceding time frame n−1 and the time frame n, so that $e_{k_{max}}$ quickly rises in response to higher $e_{p_k}[n]$, yet slowly falls in response to lower $e_{p_k}[n]$. In FIG. 5, such estimated speech levels $e_{k_{max}}$ for all N bands are notated as $e_{max}$ for simplicity.

In response to $e_{s_k}[n]$, the DSP 210 estimates (e.g., once per millisecond) a respective noise level $e_{k_{min}}$ for the kth band as $$e_{k_{min}}=\alpha_{noise}e_{k_{min}}+(1-\alpha_{noise})e_{s_k}[n], \tag{2}$$

where $\alpha_{noise}=0.95$. In that manner, $e_{k_{min}}$ rises approximately as quickly as it falls between the immediately preceding time frame n−1 and the time frame n, so that $e_{k_{min}}$ closely tracks $e_{s_k}[n]$, yet $e_{k_{min}}$ smoothes rapid changes in $e_{s_k}[n]$. In FIG. 5, such estimated noise levels $e_{k_{min}}$ for all N bands are notated as $e_{min}$ for simplicity.

In response to $e_{k_{max}}$ and $e_{k_{min}}$, the DSP 210 estimates a respective peak speech-to-noise ratio $M_k$ for the kth band, so that such peak speech-to-noise ratios for all N bands are notated as M in FIG. 5 for simplicity. Accordingly, a band's respective $M_k$ represents such band's respective long-term dynamic range, which the DSP 210 computes as $M_k=e_{k_{max}}/e_{k_{min}}$.

Also, the DSP 210 computes a respective noise suppression gain $G_k[n]$ for the kth band as $$G_k[n]=\beta_k(e_{p_k}[n])^{\alpha-1}, \tag{3}$$

where: (a) $\beta_k=(e_{k_{max}})^{(1-\alpha)}$; (b) $\alpha=1-(\log K_k/\log M_k)$; and (c) $K_k$ is an expansion factor for the kth band, so that such expansion factors for all N bands are notated as K in FIG. 5 for simplicity. Initially, the DSP 210 sets $K_k=0.01$. In real-time causal implementations of the system 200, a band's respective $M_k$, $K_k$ and $G_k[n]$ are variable per time frame n.

The DSP 210 computes $K_k$ in response to an estimate of a priori speech-to-noise ratio ("SNR"), which is a logarithmic ratio between a clean version of the signal's energy (e.g., as estimated by the DSP 210) and the noise's energy (e.g., as represented by $y_2[n]$). By comparison, a posteriori SNR is a logarithmic ratio between a noisy version of the signal's energy (e.g., speech and diffused noise as represented by $y_1[n]$) and the noise's energy (e.g., as represented by $y_2[n]$). In the illustrative embodiments, the DSP 210 performs automatic gain control ("AGC") noise suppression in response to both a posteriori SNR and estimated a priori SNR.

The DSP 210 updates (e.g., once per millisecond) its estimate of a priori SNR as $$\mathcal{R}_{prio}[n]=\alpha_{speech}\left(\frac{G_k[n-1]e_{p_k}[n]}{e_{k_{min}}}\right)^2+(1-\alpha_{speech})max\left(\left(\frac{e_{p_k}[n]}{e_{min}}\right)^2,0\right) \tag{4}$$

During the nth time frame, $\mathcal{R}_{prio}[n]$ is not yet determined exactly, so the DSP 210 updates its decision-directed estimate of $\mathcal{R}_{prio}[n]$ in response to $G_k[n-1]$ from the immediately preceding time frame n−1, as shown by Equation (4). Accordingly, the DSP 210: (a) smoothes its estimate of a priori SNR at relatively low values thereof; and (b) adjusts its estimate of a priori SNR at relatively high values thereof in a manner that closely tracks (with a delay of one time frame) a posteriori SNR. In that manner, the DSP 210 helps to reduce annoying musical noise artifacts.

The DSP 210 sets a maximum attenuation $K_{max}$, so that it determines a gain slope for a maximum a priori SNR, which is notated as $\max(\mathcal{R}_{prio})$. Similarly, the DSP 210 sets a minimum attenuation $K_{min}$, so that it determines a gain slope for a minimum a priori SNR, which is notated as $\min(\mathcal{R}_{prio})$. In one example, $K_{max}=-20$ dB, $\max(\mathcal{R}_{prio})=10$ dB, $K_{min}=-15$ dB, and $\min(\mathcal{R}_{prio})=-40$ dB.

For any particular time frame n, the DSP 210 computes $K_k$ as $$K_k=a\mathcal{R}_{prio}[n]+b, \tag{5}$$

where $$a=\frac{K_{min}-K_{max}}{\min(\mathcal{R}_{prio})-\max(\mathcal{R}_{prio})}\text{ and,} \tag{6}$$

$$b=\frac{\min(\mathcal{R}_{prio})K_{max}-\max(\mathcal{R}_{prio})K_{min}}{\min(\mathcal{R}_{prio})-\max(\mathcal{R}_{prio})}. \tag{7}$$

Figure 7:
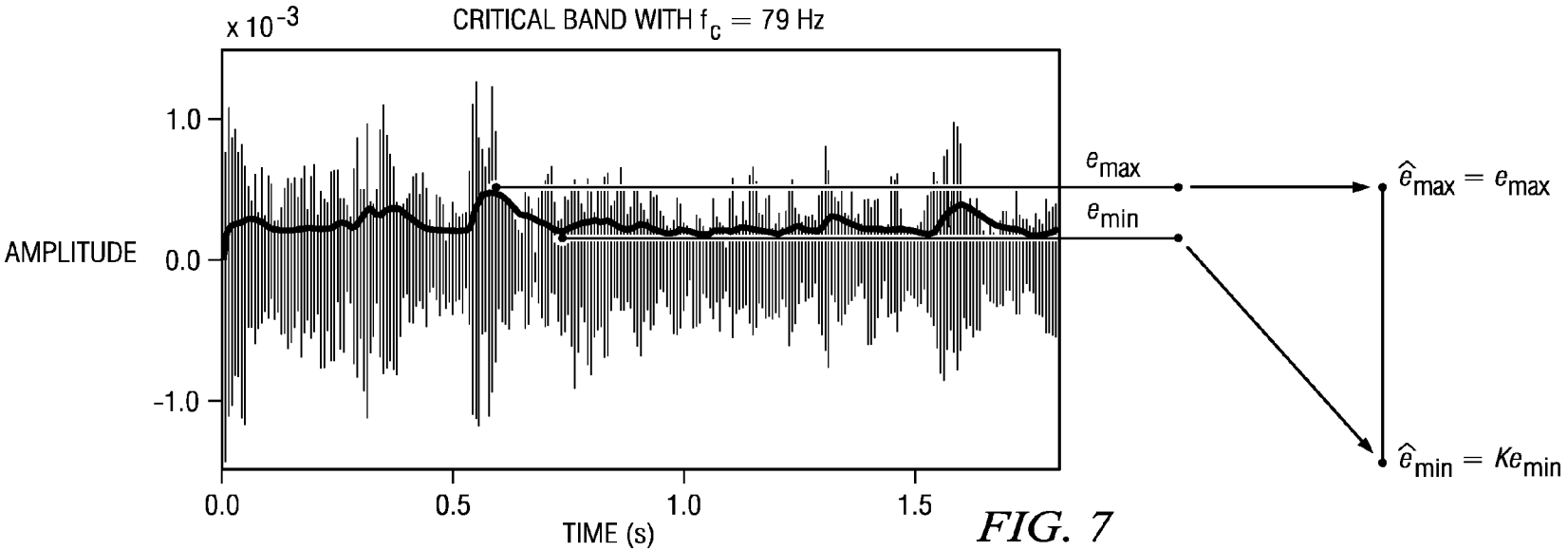
FIG. 7 is a graph of an example non-linear expansion of a speech segment's dynamic range, in which the speech segment's noise level is reduced by an expansion factor, while estimated speech level remains constant in low-frequency bands.

FIG. 7 is a graph of an example non-linear expansion of a speech segment's dynamic range, in which the speech segment's noise level $e_{min}$ is reduced by an expansion factor K<1.0, while estimated speech level $e_{max}$ remains constant in low-frequency bands (e.g., below ~200 Hz). However, in such low-frequency bands, the noise may dominate the speech, so that the estimated speech level $e_{max}$ may nevertheless correspond to the noise level $e_{min}$. Accordingly, in the example of FIG. 7, low-frequency artifacts become audible, because such expansion causes unnatural modulation in low-frequency bands where the noise is dominant.

Figure 8:
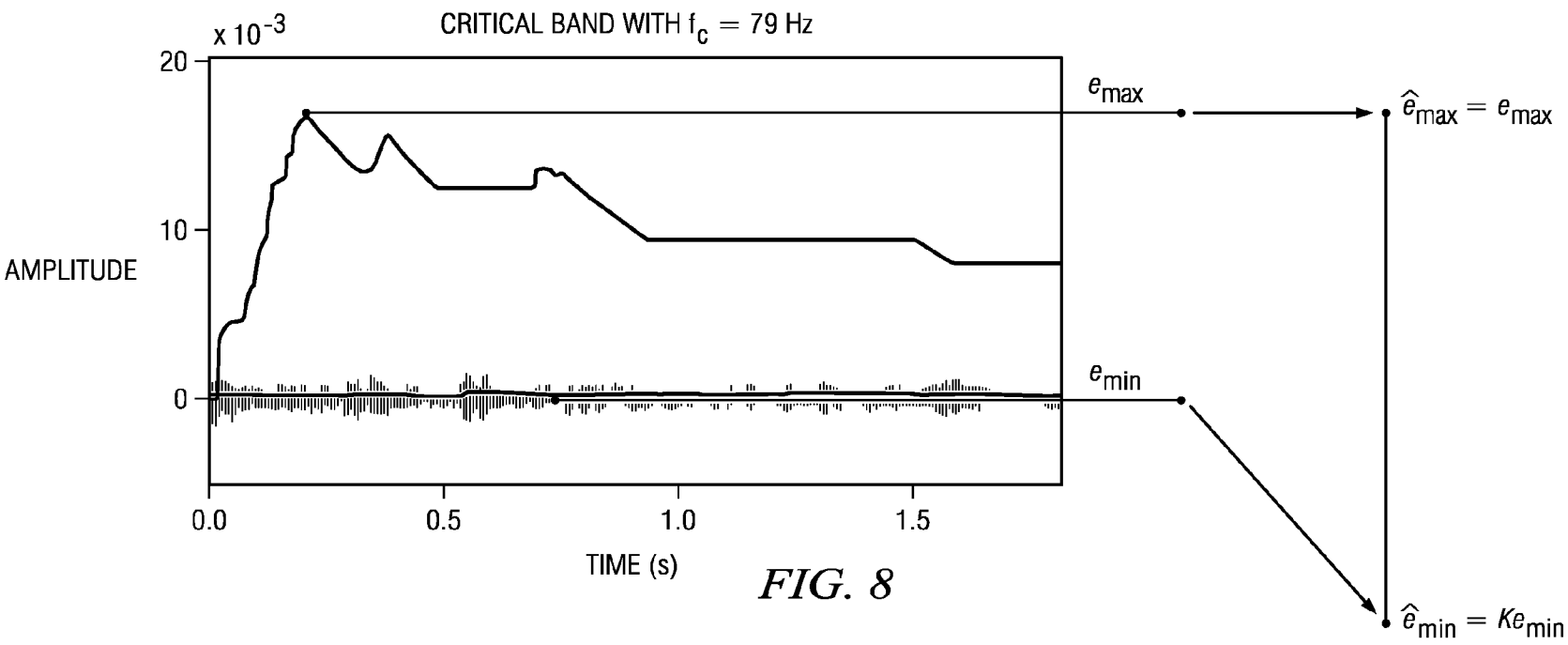
FIG. 8 is a graph of an example non-linear expansion of a speech segment's dynamic range, in which the speech segment's noise level is reduced by an expansion factor, while average speech level from speech-dominant frequency bands is applied to low-frequency bands.

FIG. 8 is a graph of an example non-linear expansion of a speech segment's dynamic range, in which the speech segment's noise level $e_{min}$ is reduced by an expansion factor K<1.0, while average speech level $e_{max}$ from speech-dominant frequency bands (e.g., between ~300 Hz and ~1000 Hz) is applied to low-frequency bands (e.g., below ~200 Hz). In comparison to the example of FIG. 7, fewer low-frequency artifacts become audible in the example of FIG. 8. Similarly, the DSP 210 effectively adjusts (e.g., non-linearly expands) a speech segment's dynamic range in the kth band by: (a) estimating the kth band's respective $e_{k_{max}}$ and $e_{k_{min}}$ in accordance with Equations (1) and (2) respectively; (b) computing the kth band's respective expansion factor $K_k$ in accordance with Equation (5); (c) in response to $e_{k_{max}}$ and $e_{k_{min}}$, estimating the kth band's respective peak speech-to-noise ratio $M_k$ as discussed hereinabove; and (d) in response to $e_{p_k}[n]$, $e_{k_{max}}$, $K_k$ and $M_k$, computing the kth band's respective noise suppression gain $G_k[n]$ in accordance with Equation (3).

In that manner, the DSP 210 performs its noise suppression operation to preserve higher quality speech, while reducing artifacts in frequency bands whose SNRs are relatively low. Accordingly, in the illustrative embodiments, $G_k[n]$ varies in response to both a posteriori SNR and estimated a priori SNR. For example, a priori SNR is represented by $K_k$, because $K_k$ varies in response to only a priori SNR, as shown by Equation (5).

Referring again to FIG. 5, after the DSP 210 computes the kth band's respective noise suppression gain $G_k[n]$ for the time frame n, the DSP 210 generates a respective noise-suppressed version $\hat{s}_{1_k}[n]$ of the primary channel's kth band $y_{1_k}[n]$ by applying $G_k[n]$ thereto (e.g., by multiplying $G_k[n]$ and the primary channel's kth band $y_{1_k}[n]$ for the time frame n). After the DSP 210 generates the respective noise-suppressed versions $\hat{s}_{k_k}[n]$ of all N bands of the primary channel for the time frame n, the DSP 210 composes $\hat{s}$ for the time frame n by performing an inverse of the auditory filter bank operation, in order to convert a sum of those noise-suppressed versions $\hat{s}_{k_k}[n]$ from a frequency domain to a time domain.

For reducing an extent of annoying musical noise artifacts in the illustrative embodiments, the DSP 210 implicitly smoothes the gain $G_k$ and thereby reduces its rate of change. In non-causal implementations: (a) a band's respective $M_k$ and $K_k$ are not variable per time frame n; and (b) a rate of change of $G_k$ with respect to time is $$\frac{dG_k}{dt} = -\frac{\log K}{\log M_k} \cdot \frac{G_k}{e_k} \cdot \frac{de_k}{dt}. \tag{8}$$

By comparison, in causal implementations, if $M_k$ is variable per time frame n, then the rate of change of $G_k$ with respect to time increases to $$\frac{dG_k}{dt} = -\frac{\log K}{\log M_k} \cdot \frac{G_k}{e_k} \cdot \frac{de_k}{dt} + G_k \cdot \ln\left(\frac{e_k}{e_{k_{max}}}\right) \cdot \frac{d}{dt}\left(-\frac{\log K}{\log M_k}\right). \tag{9}$$

The second term in Equation (9) causes a potential increase in $dG_k/dt$. For simplicity of notation, Equations (8) and (9) show $K_k$ as K.

Figure 9:
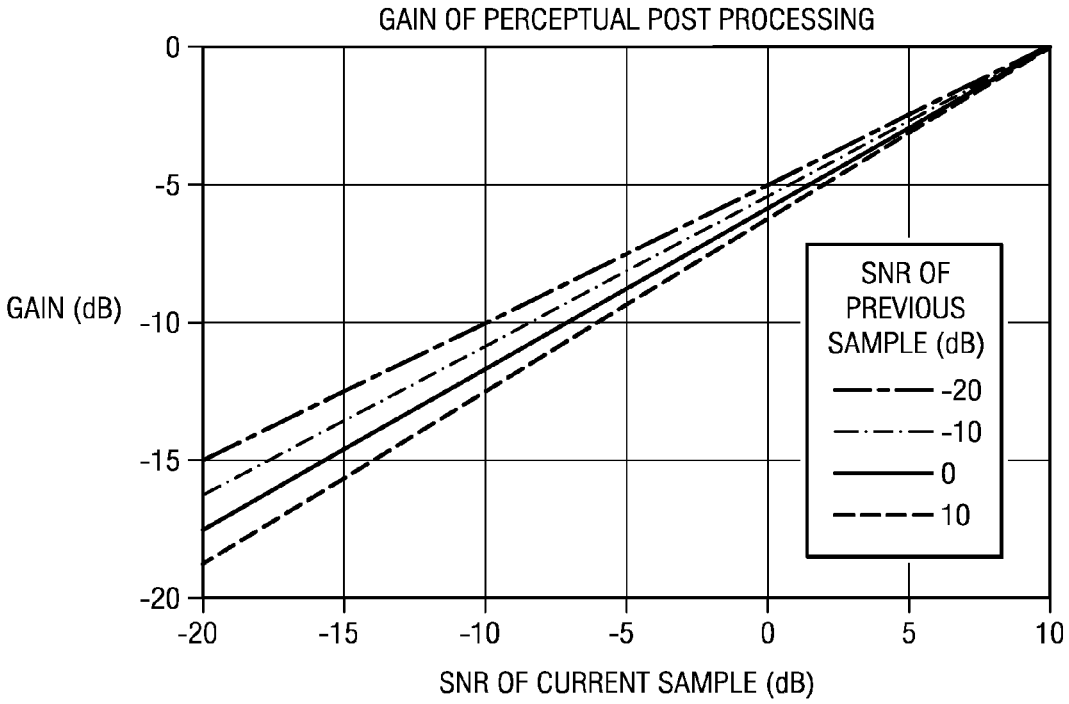
FIG. 9 is a graph of noise suppression gain in response to a signal's a posteriori speech-to-noise ratio ("SNR") for different values of the signal's a priori SNR, in accordance with one example of automatic gain control ("AGC") noise suppression in the illustrative embodiments.

FIG. 9 is a graph of noise suppression gain in response to a signal's a posteriori SNR (current sample) for different values of the signal's a priori SNR (previous sample), in accordance with one example of automatic gain control ("AGC") noise suppression in the illustrative embodiments. As shown in FIG. 9, for different values of a priori SNR, the DSP 210 attenuates the signal by respective amounts, but a range (between such respective amounts) is progressively wider in response to progressively lower values of a posteriori SNR.

In experiments where values of $\max(\mathcal{R}_{prio})$ and $\min(\mathcal{R}_{prio})$ were selected to cover a range of observed SNR, the limits of a priori SNR did not seem to change an extent of perceived musical noise artifacts. By comparison, if $K_{min}$ and $K_{max}$ were reduced to achieve more noise suppression, then more artifacts were perceived. One possibility is that, in addition to a rate of change (e.g., modulation frequency) of gain, a modulation depth of gain could also be a factor in perception of such artifacts.

To quantify a rate of change of gain, a Euclidean norm of dG/dt may be computed as $$\|\nabla G\| = \sqrt{\left(\frac{dG}{dt}\right)^2}. \tag{10}$$

In a first implementation, K is fixed over time, so it has fixed attenuation. In a second implementation, K varies according to Equation (5), so it has variable attenuation. For comparing rates of change of gain between such first and second implementations, their respective values of $\mathcal{A} = \int_t \|\nabla G\| dt$ may be computed, so that: (a) $\mathcal{A}_{fix}$ is $\mathcal{A}$ for the first implementation that has fixed attenuation; and (b) $\mathcal{A}_{var}$ is $\mathcal{A}$ for the second implementation that has variable attenuation.

Figure 10:
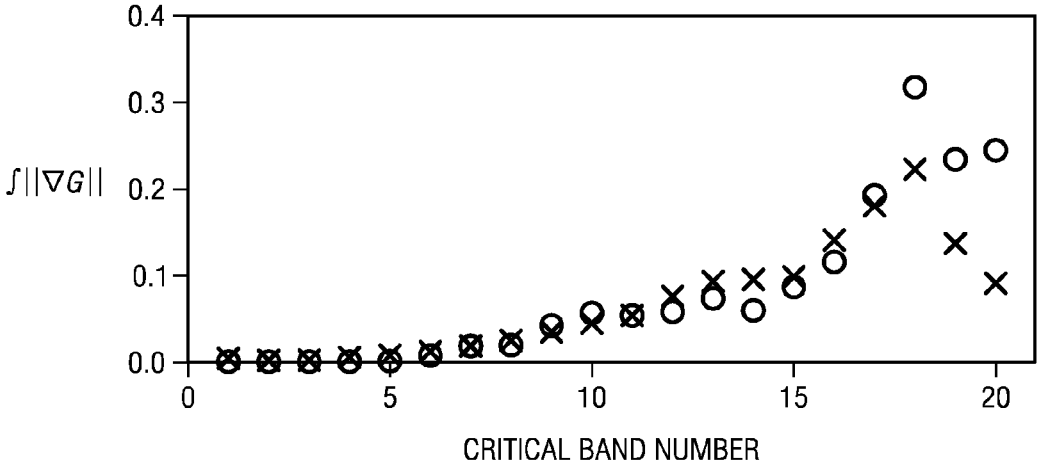
FIG. 10 is a graph of a rate of change of gain with fixed attenuation, and a rate of change of gain with variable attenuation, for various frequency bands of a speech sample that was corrupted by noise at 5 dB SNR.
Figure 11:
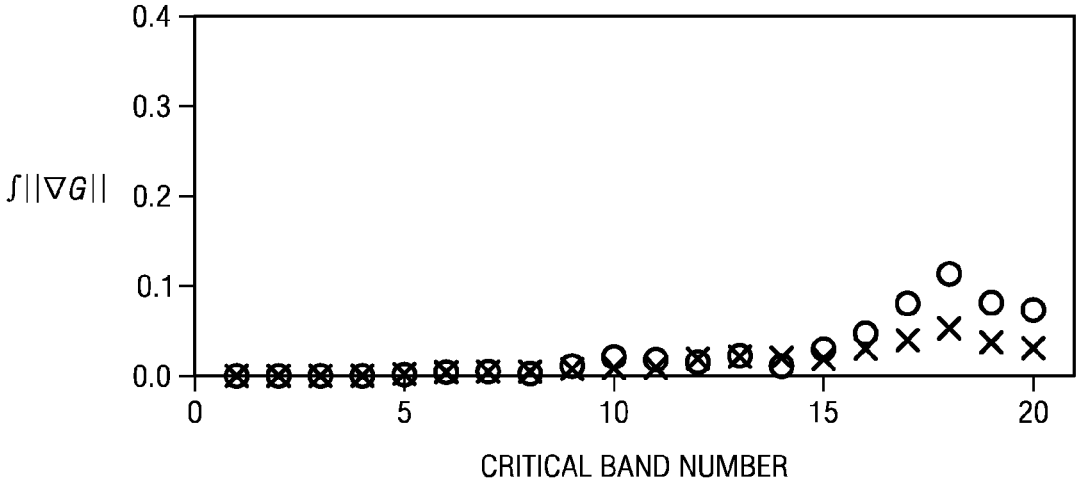
FIG. 11 is a graph of such rates of change during noise-only periods.
Figure 12:
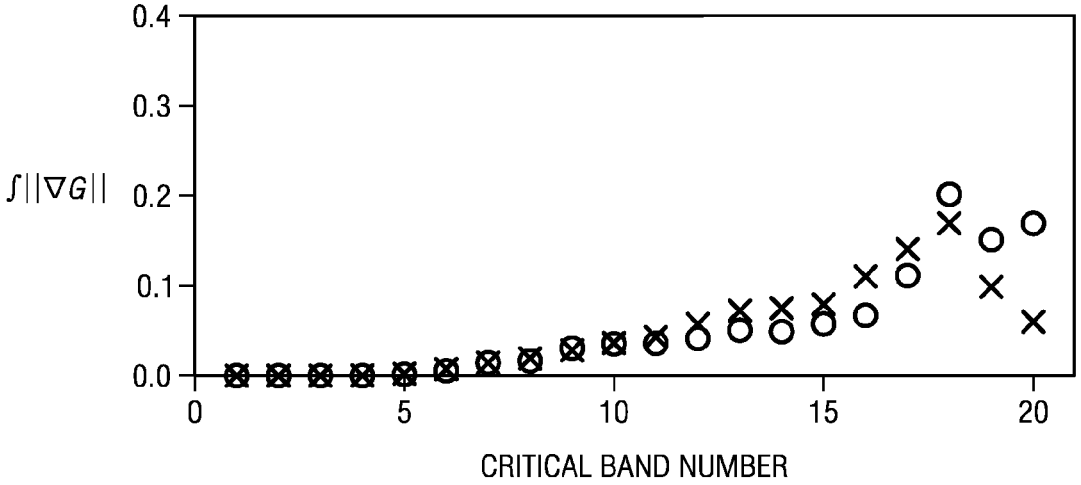
FIG. 12 is a graph of such rates of change during speech periods.

FIG. 10 is a graph of $\mathcal{A}_{fix}$ and $\mathcal{A}_{var}$ for various frequency bands of a speech sample that was corrupted by noise at 5 dB SNR. In FIGS. 12, 13 and 14, the values of $\mathcal{A}_{fix}$ are shown by "O" markings, and the values of $\mathcal{A}_{var}$ are shown by "X" markings FIG. 11 is a graph of such $\mathcal{A}_{fix}$ and $\mathcal{A}_{var}$ during noise-only periods. In the example of FIG. 11, $\mathcal{A}_{var}$ is lower than $\mathcal{A}_{fix}$ in all of the frequency bands. Accordingly, during the noise-only periods, the second implementation (in comparison to the first implementation) achieved a lower rate of change of gain. Such lower rate caused fewer musical noise artifacts.

FIG. 12 is a graph of such $\mathcal{A}_{fix}$ and $\mathcal{A}_{var}$ during speech periods. In FIG. 12, $\mathcal{A}_{var} > \mathcal{A}_{fix}$ in frequency band numbers 12-17, which correspond to speech-dominant frequencies (whose center frequencies range from 613 Hz to 1924 Hz). Accordingly, in the speech-dominant frequencies, the second implementation (in comparison to the first implementation) achieved a higher rate of change of gain. Although some musical noise artifacts were observed in the speech-dominant frequencies during those speech periods, such artifacts were not annoying, because the post processing operation was performed in a manner that preserved higher quality speech.

In the illustrative embodiments, a computer program product is an article of manufacture that has: (a) a computer-readable medium; and (b) a computer-readable program that is stored on such medium. Such program is processable by an instruction execution apparatus (e.g., system or device) for causing the apparatus to perform various operations discussed hereinabove (e.g., discussed in connection with a block diagram). For example, in response to processing (e.g., executing) such program's instructions, the apparatus (e.g., programmable information handling system) performs various operations discussed hereinabove. Accordingly, such operations are computer-implemented.

Such program (e.g., software, firmware, and/or microcode) is written in one or more programming languages, such as: an object-oriented programming language (e.g., C++); a procedural programming language (e.g., C); and/or any suitable combination thereof. In a first example, the computer-readable medium is a computer-readable storage medium. In a second example, the computer-readable medium is a computer-readable signal medium.

A computer-readable storage medium includes any system, device and/or other non-transitory tangible apparatus (e.g., electronic, magnetic, optical, electromagnetic, infrared, semiconductor, and/or any suitable combination thereof) that is suitable for storing a program, so that such program is processable by an instruction execution apparatus for causing the apparatus to perform various operations discussed hereinabove. Examples of a computer-readable storage medium include, but are not limited to: an electrical connection having one or more wires; a portable computer diskette; a hard disk; a random access memory ("RAM"); a read-only memory ("ROM"); an erasable programmable read-only memory ("EPROM" or flash memory); an optical fiber; a portable compact disc read-only memory ("CD-ROM"); an optical storage device; a magnetic storage device; and/or any suitable combination thereof.

A computer-readable signal medium includes any computer-readable medium (other than a computer-readable storage medium) that is suitable for communicating (e.g., propagating or transmitting) a program, so that such program is processable by an instruction execution apparatus for causing the apparatus to perform various operations discussed hereinabove. In one example, a computer-readable signal medium includes a data signal having computer-readable program code embodied therein (e.g., in baseband or as part of a carrier wave), which is communicated (e.g., electronically, electromagnetically, and/or optically) via wireline, wireless, optical fiber cable, and/or any suitable combination thereof.

Although illustrative embodiments have been shown and described by way of example, a wide range of alternative embodiments is possible within the scope of the foregoing disclosure.

What is claimed is:

1. A method performed by an information handling system for suppressing noise, the method comprising:

receiving a first signal that represents speech and the noise, wherein the noise includes directional noise and diffused noise;

receiving a second signal that represents the noise and leakage of the speech;

in response to the first and second signals, generating: a first channel of information that represents the speech and the diffused noise while suppressing most of the directional noise from the first signal; and a second channel of information that represents the noise while suppressing most of the speech from the second signal; and in response to the first and second channels, generating frequency bands of an output channel of information that represents the speech while suppressing most of the noise from the first channel;

wherein the frequency bands include at least N frequency bands, wherein k is an integer number that ranges from 1 through N, and wherein generating a kth frequency band of the output channel includes: in response to a first envelope within the kth frequency band of the first channel, estimating a speech level within the kth frequency band of the first channel; in response to a second envelope within the kth frequency band of the second channel, estimating a noise level within the kth frequency band of the second channel; computing a noise suppression gain for a time frame n in response to the estimated speech level for a preceding time frame, the estimated noise level for the preceding time frame, the estimated speech level for the time frame n, and the estimated noise level for the time frame n; and generating the kth frequency band of the output channel for the time frame n in response to multiplying the noise suppression gain for the time frame n and the kth frequency band of the first channel for the time frame n.

2. The method of claim 1, wherein the frequency bands include at least first and second frequency bands that partially overlap one another.

3. The method of claim 2, wherein the frequency bands are suitable for human perceptual auditory response.

4. The method of claim 1, and comprising: performing a first filter bank operation for converting a time domain version of the first channel to the frequency bands of the first channel; and performing a second filter bank operation for converting a time domain version of the second channel to the frequency bands of the second channel.

5. The method of claim 4, and comprising: generating the output channel, wherein generating the output channel includes performing an inverse of the first filter bank operation for converting a sum of the frequency bands of the output channel to a time domain.

6. The method of claim 1, wherein estimating the speech level includes: estimating the speech level so that it rises more quickly than it falls between a preceding time frame and a time frame n.

7. The method of claim 6, wherein estimating the noise level includes: estimating the noise level so that it rises approximately as quickly as it falls between the preceding time frame and the time frame n.

8. The method of claim 1, wherein estimating the speech level includes: with a low-pass filter, identifying the first envelope within the kth frequency band of the first channel.

9. The method of claim 8, wherein the low-pass filter is a first low-pass filter, and wherein estimating the noise level includes: with a second low-pass filter, identifying the second envelope within the kth frequency band of the second channel.

10. The method of claim 1, wherein computing the noise suppression gain includes:

computing a first speech-to-noise ratio of the kth band for the preceding time frame, wherein computing the first speech-to-noise ratio includes dividing the estimated speech level for the preceding time frame by the estimated noise level for the preceding time frame;

computing a second speech-to-noise ratio of the kth band for the time frame n, wherein computing the second speech-to-noise ratio includes dividing the estimated speech level for the time frame n by the estimated noise level for the time frame n; and computing the noise suppression gain in response to the first and second speech-to-noise ratios.

11. A system for suppressing noise, the system comprising:

at least one device for: receiving a first signal that represents speech and the noise, wherein the noise includes directional noise and diffused noise; receiving a second signal that represents the noise and leakage of the speech; in response to the first and second signals, generating: a first channel of information that represents the speech and the diffused noise while suppressing most of the directional noise from the first signal; and a second channel of information that represents the noise while suppressing most of the speech from the second signal; and, in response to the first and second channels, generating frequency bands of an output channel of information that represents the speech while suppressing most of the noise from the first channel;

wherein the frequency bands include at least N frequency bands, wherein k is an integer number that ranges from 1 through N, and wherein generating a kth frequency band of the output channel includes: in response to a first envelope within the kth frequency band of the first channel, estimating a speech level within the kth frequency band of the first channel; in response to a second envelope within the kth frequency band of the second channel, estimating a noise level within the kth frequency band of the second channel; computing a noise suppression gain for a time frame n in response to the estimated speech level for a preceding time frame, the estimated noise level for the preceding time frame, the estimated speech level for the time frame n, and the estimated noise level for the time frame n; and generating the kth frequency band of the output channel for the time frame n in response to multiplying the noise suppression gain for the time frame n and the kth frequency band of the first channel for the time frame n.

12. The system of claim 11, wherein the frequency bands include at least first and second frequency bands that partially overlap one another.

13. The system of claim 12, wherein the frequency bands are suitable for human perceptual auditory response.

14. The system of claim 11, wherein the at least one device is for: performing a first filter bank operation for converting a time domain version of the first channel to the frequency bands of the first channel; and performing a second filter bank operation for converting a time domain version of the second channel to the frequency bands of the second channel.

15. The system of claim 14, wherein the at least one device is for: generating the output channel, wherein generating the output channel includes performing an inverse of the first filter bank operation for converting a sum of the frequency bands of the output channel to a time domain.

16. The system of claim 11, wherein estimating the speech level includes: estimating the speech level so that it rises more quickly than it falls between a preceding time frame and a time frame n.

17. The system of claim 16, wherein estimating the noise level includes: estimating the noise level so that it rises approximately as quickly as it falls between the preceding time frame and the time frame n.

18. The system of claim 11, wherein estimating the speech level includes: with a low-pass filter, identifying the first envelope within the kth frequency band of the first channel.

19. The system of claim 18, wherein the low-pass filter is a first low-pass filter, and wherein estimating the noise level includes: with a second low-pass filter, identifying the second envelope within the kth frequency band of the second channel.

20. The system of claim 11, wherein computing the noise suppression gain includes:

computing a first speech-to-noise ratio of the kth band for the preceding time frame, wherein computing the first speech-to-noise ratio includes dividing the estimated speech level for the preceding time frame by the estimated noise level for the preceding time frame;

computing a second speech-to-noise ratio of the kth band for the time frame n, wherein computing the second speech-to-noise ratio includes dividing the estimated speech level for the time frame n by the estimated noise level for the time frame n; and computing the noise suppression gain in response to the first and second speech-to-noise ratios.

21. A computer program product for suppressing noise, the computer program product comprising:

a tangible computer-readable storage medium; and a computer-readable program stored on the tangible computer-readable storage medium, wherein the computer-readable program is processable by an information handling system for causing the information handling system to perform operations including: receiving a first signal that represents speech and the noise, wherein the noise includes directional noise and diffused noise; receiving a second signal that represents the noise and leakage of the speech; in response to the first and second signals, generating: a first channel of information that represents the speech and the diffused noise while suppressing most of the directional noise from the first signal; and a second channel of information that represents the noise while suppressing most of the speech from the second signal; and, in response to the first and second channels, generating frequency bands of an output channel of information that represents the speech while suppressing most of the noise from the first channel;

wherein the frequency bands include at least N frequency bands, wherein k is an integer number that ranges from 1 through N, and wherein generating a kth frequency band of the output channel includes: in response to a first envelope within the kth frequency band of the first channel, estimating a speech level within the kth frequency band of the first channel; in response to a second envelope within the kth frequency band of the second channel, estimating a noise level within the kth frequency band of the second channel; computing a noise suppression gain for a time frame n in response to the estimated speech level for a preceding time frame, the estimated noise level for the preceding time frame, the estimated speech level for the time frame n, and the estimated noise level for the time frame n; and generating the kth frequency band of the output channel for the time frame n in response to multiplying the noise suppression gain for the time frame n and the kth frequency band of the first channel for the time frame n.

22. The computer program product of claim 21, wherein the frequency bands include at least first and second frequency bands that partially overlap one another.

23. The computer program product of claim 22, wherein the frequency bands are suitable for human perceptual auditory response.

24. The computer program product of claim 21, wherein the operations include: performing a first filter bank operation for converting a time domain version of the first channel to the frequency bands of the first channel; and performing a second filter bank operation for converting a time domain version of the second channel to the frequency bands of the second channel.

25. The computer program product of claim 24, wherein the operations include: generating the output channel, wherein generating the output channel includes performing an inverse of the first filter bank operation for converting a sum of the frequency bands of the output channel to a time domain.

26. The computer program product of claim 21, wherein estimating the speech level includes: estimating the speech level so that it rises more quickly than it falls between a preceding time frame and a time frame n.

27. The computer program product of claim 26, wherein estimating the noise level includes: estimating the noise level so that it rises approximately as quickly as it falls between the preceding time frame and the time frame n.

28. The computer program product of claim 21, wherein estimating the speech level includes: with a low-pass filter, identifying the first envelope within the kth frequency band of the first channel.

29. The computer program product of claim 28, wherein the low-pass filter is a first low-pass filter, and wherein estimating the noise level includes: with a second low-pass filter, identifying the second envelope within the kth frequency band of the second channel.

30. The computer program product of claim 21, wherein computing the noise suppression gain includes:

computing a first speech-to-noise ratio of the kth band for the preceding time frame, wherein computing the first speech-to-noise ratio includes dividing the estimated speech level for the preceding time frame by the estimated noise level for the preceding time frame;

computing a second speech-to-noise ratio of the kth band for the time frame n, wherein computing the second speech-to-noise ratio includes dividing the estimated speech level for the time frame n by the estimated noise level for the time frame n; and computing the noise suppression gain in response to the first and second speech-to-noise ratios.

* * * * *